US006572302B2

(12) United States Patent
Gogoana

(10) Patent No.: US 6,572,302 B2
(45) Date of Patent: Jun. 3, 2003

(54) FLEXIBLE LAMINATIONS

(75) Inventor: Marian V. Gogoana, P.O. 351, McLean, VA (US) 22101

(73) Assignee: Marian V. Gogoana, McLean, VA (US)

( * ) Notice: Subject to any disclaimer, the term of this patent is extended or adjusted under 35 U.S.C. 154(b) by 29 days.

(21) Appl. No.: 09/799,520

(22) Filed: Mar. 7, 2001

(65) Prior Publication Data

US 2001/0045736 A1 Nov. 29, 2001

Related U.S. Application Data

(60) Provisional application No. 60/187,857, filed on Mar. 8, 2000.

(51) Int. Cl.[7] ..... B42F 13/00

(52) U.S. Cl. ..... 402/79; 281/38; 281/21.1

(58) Field of Search ..... 402/79, 73, 70, 402/80 R; 281/38, 21.1, 2, 5, 3.1

(56) References Cited

U.S. PATENT DOCUMENTS

| | | | | |
|---|---|---|---|---|
| 3,954,548 A | | 5/1976 | Polit | |
| 3,956,057 A | | 5/1976 | Jung | |
| 4,507,885 A | | 4/1985 | Kinnard | |
| 4,818,168 A | | 4/1989 | Battisti | |
| 5,087,145 A | | 2/1992 | Cooley | |
| RE34,917 E | | 4/1995 | Parkhill et al. | |
| 6,012,866 A | | 1/2000 | Podosek | |
| 6,139,209 A | * | 10/2000 | Nicol | 402/79 |
| 6,183,158 B1 | | 2/2001 | Lynton | |

FOREIGN PATENT DOCUMENTS

| | | |
|---|---|---|
| EP | 0 796 175 B1 | 9/1997 |

* cited by examiner

*Primary Examiner*—Willmon Fridie, Jr.

(57) ABSTRACT

The present invention provides techniques for imparting both flexibility and lamination to leaves or sheets comprising laminate films, including but not limited to leaves or sheets which at least partially enclose or encase printed matter to or between laminate film(s). The first laminate film and the second laminate film may or may not have part of all of a segment of printed matter, e.g., a display content sheet, positioned or sandwiched therebetween. All embodiments have a flex or flexible zone which provides flexibility to the leaf or sheet, the thickness of the flex zone being thinner than the thickness of portions of the leaf or sheet having two laminate films. The flex zone of each sheet or leaf provides flexibility for the leaf at strategic locations, the remainder of the sheet or leaf having durability and stiffness as afforded by the two films of lamination and the adhesive utilized in conjunction with one or both of the two lamination films.

31 Claims, 5 Drawing Sheets

FIG. 1A
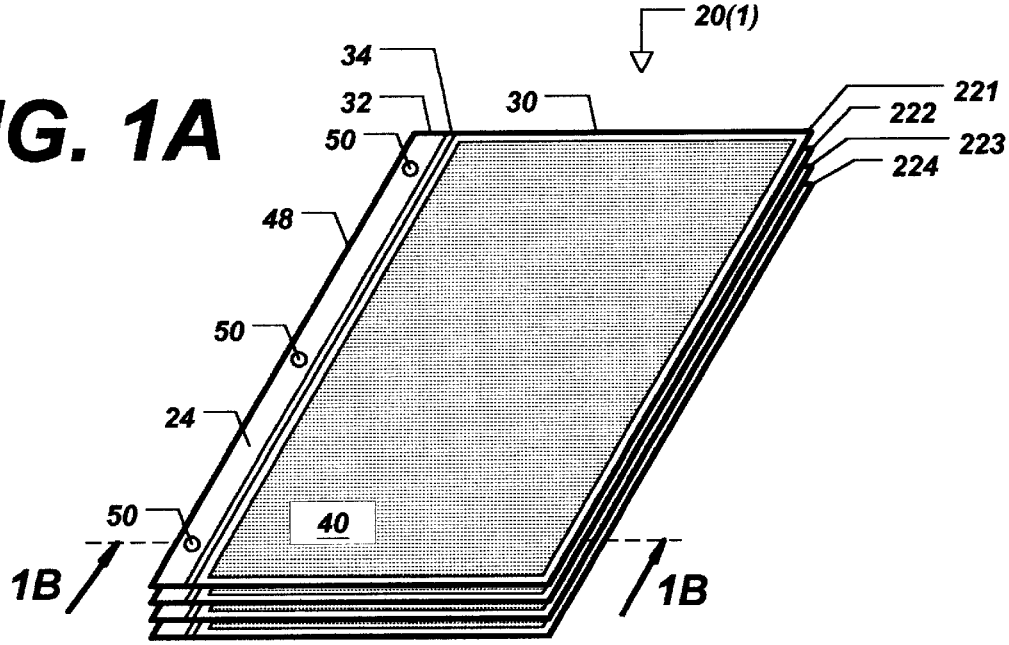
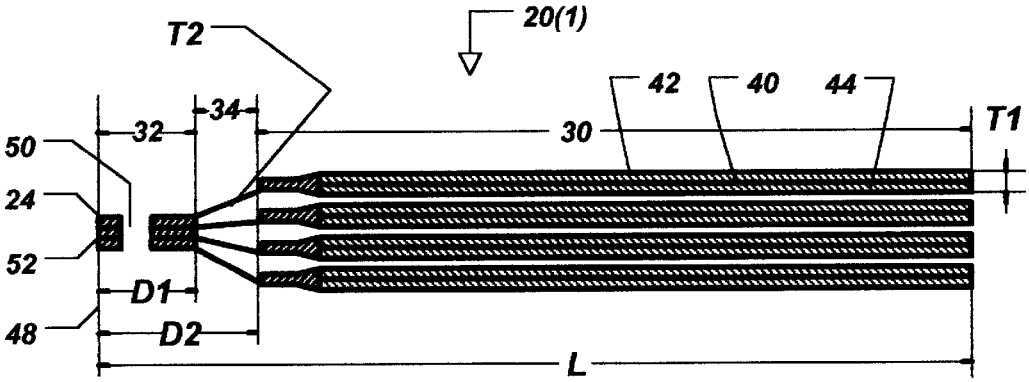
Fig. 1B

Fig. 2A
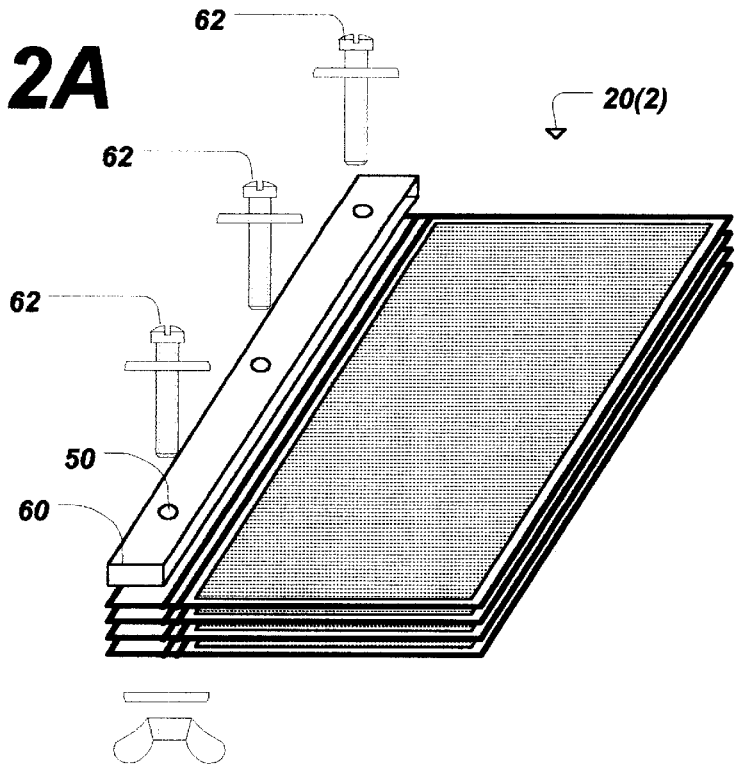
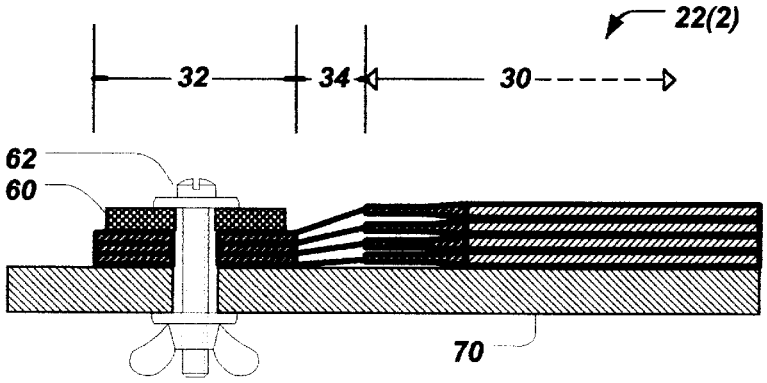
Fig. 2B
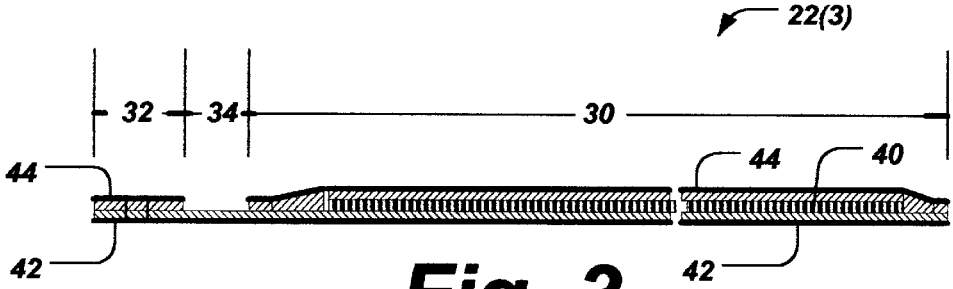
Fig. 3

FLEXIBLE LAMINATIONS

This application claims the benefit and priority of U.S. Provisional Patent Application Ser. No. 60/187,857 filed Mar. 8, 2000, which is incorporated by reference herein in its entirety.

BACKGROUND

1. Field of the Invention

The present invention pertains to lamination technology, and particularly to extending the applicability of said technology by increasing the ability to bend of printed matter.

2. Related Art and Other Considerations

For over a century merchants and service organizations have utilized catalogs for providing effective visual displays of their products and services. The catalogs typically include a plurality of essentially planar leaves, usually with each leaf having a display page on each of the two sides of the leaf. Some catalogs are mailed or otherwise provided to potential customers for reference at the immediate customers residence or business. Usually these mailed catalogs are bound like a book, so that upon opening of the catalog the binding acquires an accurate shape and thus essentially is responsible for allowing displacement of the edges of the catalog pages relative to one another.

Other catalogs, generally more expensive to produce and perhaps more detailed and/or more merchandise-current, physically remain at the merchant/service provider's place of business for ready reference by browsing or searching customers. In view of the frequency of use of such on-site catalogs, the catalogs must be durable, e.g., able to withstand constant manipulation and environmental conditions/situations (moisture, spills, etc.). But at the same time the on-site catalogs must be attractive and user-friendly (easy to open, turn the leaves, and so forth).

For achieving such durability, some catalogs have their leaves formed by interposing a display sheet or the like between laminate films. Typically the laminate films have an adhesive which is heat activated as the display sheet is interposed therebetween, thereby securing and sealing the display sheet between the laminate films. A considerable amount of the thickness of the laminate films is attributable to their adhesive component. The leaves are then bound between retaining members, such as metal strips for example. Examples of such catalogs are illustrated in European Patent EP 076175, which discloses each leaf having two laminate films extending into a binding region of the catalog.

While the lamination of catalog leaves provides a reasonable measure of durability essentially without sacrificing transparency of the printed matter of the display sheet, in some instances such laminated catalogs can be rather rigid and awkward to manipulate. Unlike book-like bindings, the retaining members themselves between which the laminated leaves are bound do not facilitate displacement of the leaves. Moreover, for this and other reasons it is generally not feasible to turn a leaf through three hundred sixty degrees range of motion. Consequentially, catalog browsers are constrained in viewing and turning the catalog pages. Such encumbrances militate against relaxed and reflective perusal of the catalog, and thus defeat efforts by the merchant to provide a convenient and accommodating salesroom atmosphere.

Laminated pages can be employed in other products besides catalogs. But the stiffness and rigidity traditionally characterized by lamination severely limits the scope and nature of such products. What is needed, therefore, and an object of the present invention, is a technique for imparting both flexibility and lamination to printed matter.

BRIEF SUMMARY OF THE INVENTION

The present invention provides techniques for imparting both flexibility and lamination to leaves or sheets comprising laminate films, including but not limited to leaves or sheets which at least partially enclose or encase printed matter to or between laminate film(s). The first laminate film and the second laminate film may or may not have part of all of a segment of printed matter, e.g., a display content sheet, positioned or sandwiched therebetween. All embodiments have a flex or flexible zone which provides flexibility to the leaf or sheet, the thickness of the flex zone being thinner than the thickness of portions of the leaf or sheet having two laminate films.

For those embodiments having printed matter, some portions of the printed matter are interposed between two laminate films in one or more display zones of a leaf or sheet. The leaf or sheet also has one or more flex zones wherein the printed matter is contacted by at least one, and preferably only one, laminate film. The flex zone(s) have a thickness which is less than the thickness of the display zone(s). The flex zone of each sheet or leaf provides flexibility for the leaf at strategic locations, the remainder of the sheet or leaf having durability and stiffness as afforded by the two films of lamination and the adhesive utilized in conjunction with one or both of the two lamination films.

Catalogs according to the invention comprise a plurality of leaves and a binder which secures the leaves in fixed relation to one another. The leaves of the catalog have three zones or areas of interest: a display zone; a binding zone; and a flex zone. The display zone is a three-layer zone which includes a display content sheet interposed between two laminate films. The three-layered display zone has a composite thickness T1.

The binding zone is the region along an edge of each leaf wherein the plurality of leaves interface with the binder. Various embodiments of the present invention are distinguishable by the techniques and/or apparatus which characterize the binder (e.g., adhesives, fasteners, etc.).

The flex zone in the catalogue implementation is situated intermediate the display zone and the binding zone. The flex zone comprises at least, and preferably only one, laminate film. The flex zone has a thickness T2 which is less than the thickness T1 of the display zone. In one embodiment, the smaller thickness T2 of the flex zone relative to the thickness T1 of display zone is achieved by having the flex zone formed from only one laminate film. The flex zone of each leaf provides enhanced flexibility for the leaf, and permits presentations formed from the leaves of the present invention to bend through a range of angles including three hundred sixty degrees, as well as to acquire various use configurations.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 1A is a top isometric view of a catalog according to a first embodiment of the invention.

FIG. 1B is a sectioned side view of the catalog of FIG. 1A.

FIG. 2A is a top isometric view of a catalog according to a second embodiment of the invention.

FIG. 2B is a sectioned side view of the catalog of FIG. 2A.

FIG. 3 is a sectioned side view of a leaf for a catalog according to another embodiment of the invention.

DETAILED DESCRIPTION OF THE DRAWINGS

Figure 4:
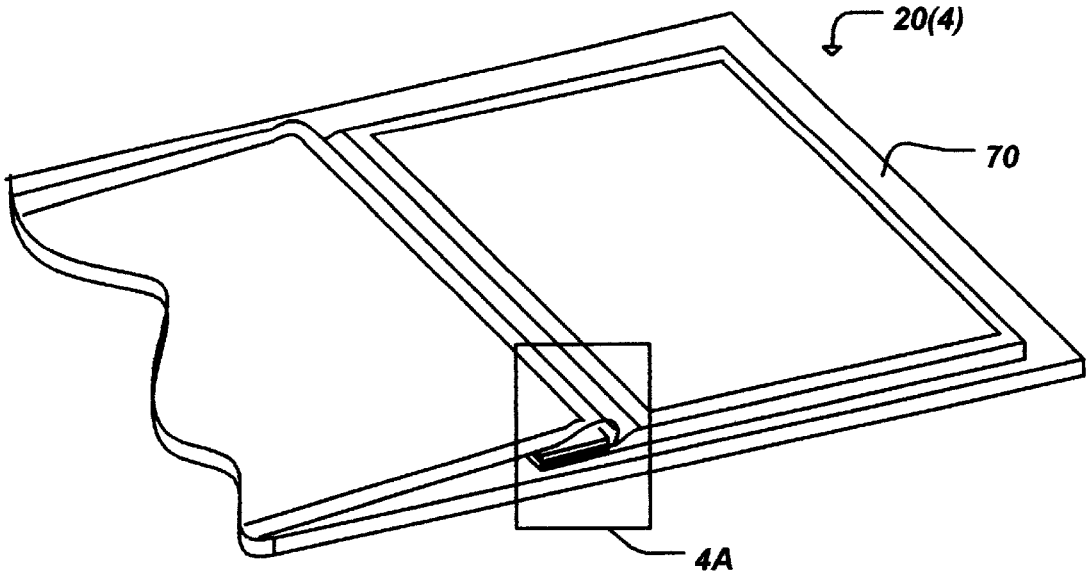
FIG. 4 is a perspective view of a catalog according to the present invention oriented in a horizontal configuration.

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. In other instances, detailed descriptions of well known devices and methods are omitted so as not to obscure the description of the present invention with unnecessary detail.

The present invention provides techniques for imparting both flexibility and lamination to leaves or sheets comprising laminate films, including but not limited to leaves or sheets which at least partially enclose or encase printed matter to or between laminate film(s). As used herein, the terms "leaf" and "sheet" and their plurals encompass a substrate (which may be a first laminate film) which has a second laminate film positioned over at least a part of the substrate. The first laminate film and the second laminate film may or may not have part of all of a segment of printed matter, e.g., a display content sheet, positioned or sandwiched therebetween. All embodiments have a flex or flexible zone which provides flexibility to the leaf or sheet, the thickness of the flex zone being thinner than the thickness of portions of the leaf or sheet having two laminate films.

For those embodiments having printed matter, some portions of the printed matter are interposed between two laminate films in one or more display zones of the leaf or sheet. The leaf or sheet also has one or more flex zones wherein the printed matter is contacted by at least one, and preferably only one, laminate film. The flex zone(s) have a thickness which is less than the thickness of the display zone(s). The flex zone of each sheet or leaf provides flexibility for the leaf at strategic locations, the remainder of the sheet or leaf having durability and stiffness as afforded by the two films of lamination and the adhesive utilized in conjunction with each of the two lamination films.

One aspect of the present invention encompasses various embodiments of flexible laminated leaves or sheets as described herein. Another aspect of the present invention are various contexts of implementation for such sheets, including the non-limiting context of a bound publication such as a catalog (e.g., a merchandise catalog, for example).

FIG. 1A and FIG. 1B show a first embodiment of a catalog 20(1) according to the present invention. The catalog 20(1) comprises a plurality of leaves 22, of which four such leaves $\mathbf{22}_1$–$\mathbf{22}_4$ are illustrated in FIG. 1A and FIG. 1B. In addition to its leaves 22, the catalog 20(1) has a binder 24, as subsequently described, for securing the plurality of leaves 22 in fixed relation to one another. It should be understood the catalog 20(1) is shown as comprising only four pages for sake of simplicity of illustration, and that a greater number of pages (or even lesser number of pages) is within the ambit of the present invention.

At least one, and preferably all of the leaves 22 of catalog 20(1) have three zones or areas of interest. These zones of interest, illustrated in FIG. 1B, are display zone 30; binding zone 32; and flex zone 34.

The display zone 30 comprises a display content sheet 40 interposed between two laminate films 42 and 44. The display zone 30 thus comprises three layers: display content sheet 40 and two laminate films 42 and 44. The three-layered display zone 30 has a composite thickness T1, as illustrated in FIG. 1B.

As in the case of other laminate films described herein, laminate films 42 and 44 are shown as having a transparent film portion depicted by dark solid lines, and an adhesive shown by cross hatching adjacent to the dark solid line. For example, in FIG. 1B the upper laminate film 42 has an adhesive layer shown beneath the solid line labeled 42; the lower laminate film 44 has an adhesive layer shown above the solid line labeled 42. The lower laminate film 44 can function as a substrate.

At least one, and preferably both, of the two laminate films 42 and 44 are at least semi-transparent, so that at least one and preferably both sides of display content sheet 40 are readily visible through laminate films 42 and 44, respectively. Such polyethylene films are generally heat activated at temperatures on the order of between 200° F. and 300° F. or pressure activated films.

The binding zone 32 is the region along an edge of each leaf 22 wherein the plurality of leaves interface with binder 24. As subsequently explained, various embodiments of the present invention are distinguishable by the techniques and/or apparatus which characterize binder 24.

The flex zone 34 is situated intermediate display zone 30 and binding zone 32. The flex zone 34 comprises at least, and preferably only one, laminate film (e.g., laminate film 34 in the illustrated example). The flex zone 34 has a thickness T2. Significantly, the thickness T2 of flex zone 34 is less than the thickness T1 of display zone 30. In the illustrated embodiments, the smaller thickness T2 of flex zone 34 relative to thickness T1 of display zone 30 is achieved by having the flex zone 34 formed from only one laminate film (e.g., film 42). In one example embodiment, the thickness T2 for the flex zone 34 is less than 5 mils, and preferably less than 3 mils As previously stated, the binding zone 32 extends along a binding edge 48 of the leaves 22, such as the left edge shown in FIG. 1A and FIG. 1B. In its binding zone 32, each leaf 22 can have one or more binding perforations 50, three such perforations being illustrated in FIG. 1A. In the illustrated example embodiment, the flex zone 34 extends essentially parallel to the binding zone 32, e.g., parallel to binding edge 48.

As shown in FIG. 1A, each leaf 22 has a length L extending in a direction perpendicular from binding edge 48. FIG. 1B further shows flex zone 34 as extending between a distance D1 and D2 away from binding edge 48 (in the direction perpendicular to binding edge 48).

In the catalog 20(1) of FIG. 1A and FIG. 1B, the binder 24 essentially comprises a glue or adhesive generally depicted by numeral 52 in FIG. 1B. The adhesive 52 can be, for example, the layer of adhesive that ordinarily accompanies a polypropylene film suitable for lamination purposes. Such an adhesive binder can be used exclusively or in addition with other binding techniques and apparatus.

The catalog 20(2) of FIG. 2A and FIG. 2B essentially differs from catalog 20(1) of FIG. 1A and FIG. 1B in the type of binder utilized. For this reason, such matters as the three-layer composition of display zone 30 and the various dimensions are not explicitly numbered in FIG. 2A and FIG. 2B, but otherwise are understood to be consistent with the embodiment of catalog 20(1) of FIG. 1A and FIG. 1B. In particular, the binder 24 utilized in catalog 20(2) of FIG. 2A and FIG. 2B comprises a retaining bar 60 and a plurality of penetrating fasteners 62. The retaining bar 60 has holes which are aligned with leaf perforations 50, so that fasteners 62 can extend both through the holes in retaining bar 60 and the leaf perforations 50 in all leaves 22. For the catalog 20(2) of FIG. 2A and FIG. 2B, a distal end of each of the fasteners 62 is secured into a substrate 70. The substrate 70 could be an appropriate flat surface, such as a table top or wall, for example. Alternatively, if catalog 20(2) of FIG. 2A and FIG. 2B is to be mobile and transportable, the distal ends of each of the fasteners 62 could be anchored or otherwise secured to a companion retaining bar (which is essentially the mirror image of retaining bar 60). The retaining bars herein illustrated can be formed of any suitable material, such as metal or durable plastic, for example.

The particular fasteners 62 shown in FIG. 2A and FIG. 2B are merely illustrative of the many types of fasteners that can be employed. For example, in some embodiments staples or the like can serve as suitable fasteners. Moreover, when a fastener (such as staples) are employed, a plastic slider member of the like may be slid over the binding edge, in similar manner to sliding of such a member on a report folder or the like.

In the embodiments thus far illustrated, the binding zone 32 of each leaf 22 also has a thickness T2 (i.e., the same thickness as the flex zone 34). This does not necessarily mean, however, that the composite thickness of the binder 24 is merely the summation of the thickness T2 for each of the leaves 22 included in the catalog 20. Rather, it should be understood that the binder 24 itself may, and likely does, contribute to the thickness of the catalog in the binding region. For example, in the catalog 20(1) of FIG. 1A and FIG. 1B the adhesive employed to secure the leaves to one another contributes to increase the overall thickness of binder 24.

FIG. 3 shows a leaf 22(3) which can be employed in a yet further embodiment of the catalogs 20 of the present invention. The leaf 22(3) differs from the leaves 22 previously illustrated in that the binding zone 32 comprises two, rather than one, lamination film. That is, leaf 22(3) is a two-layered zone having both laminate films 42 and 44. The structure of FIG. 3 can be employed for catalogs in which reinforcement is particularly desirable in binding zone 32. Such reinforcement may be advantageous, for example, in embodiments having perforations 50 which otherwise might, under pressure, tear or otherwise become disfigured, causing misalignment or even release of a leaf from the catalog.

In all illustrated embodiments, the fact that the flex zone 34 has a smaller thickness T2 than the thickness T1 of display zone 30 imparts greater flexibility to each leaf 22. The enhanced flexibility facilitated by flex zone 34 allows the catalogs of the present invention to have many possible orientations in use, and further allows each leaf 22 to be turned through a range of three hundred sixty degrees.

Figure 4A:
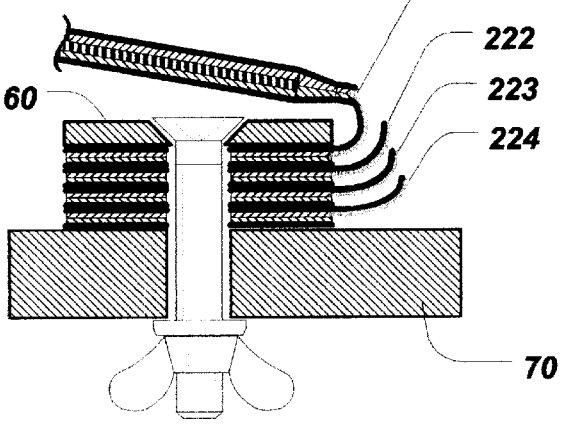
FIG. 4A is a detailed view of a portion of FIG. 3.
Figure 5:
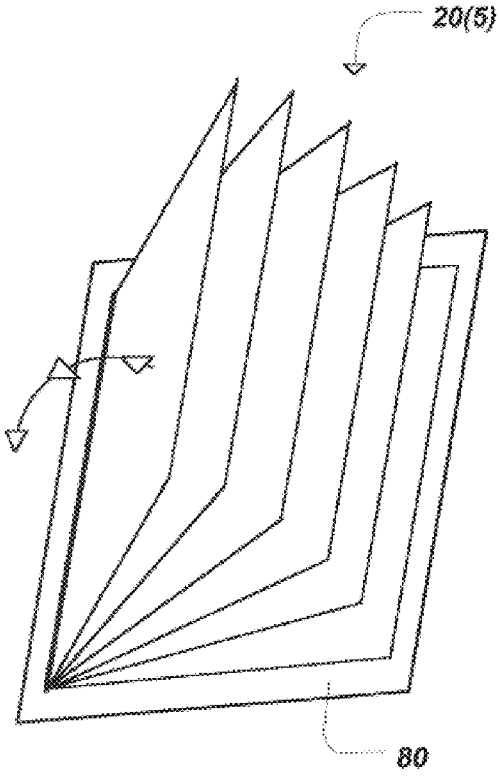
FIG. 5 is a perspective view of a catalog according to the p resent invention oriented in a vertical configuration.
Figure 6:
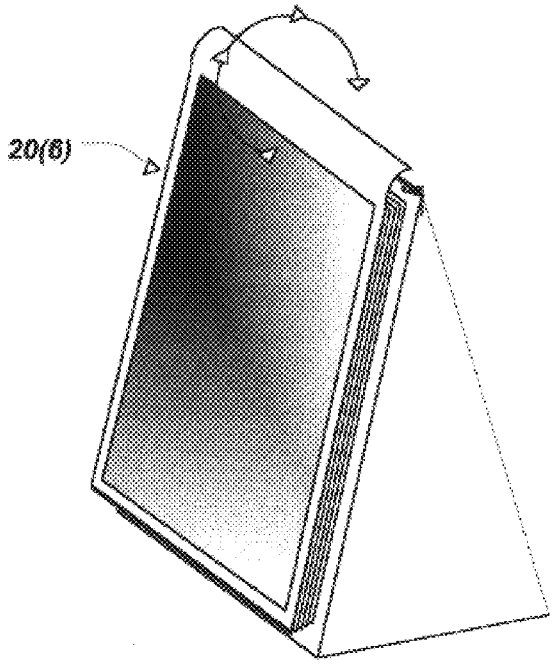
FIG. 6 is a perspective view of a catalog according to the present invention oriented in an easel configuration.
Figure 7:
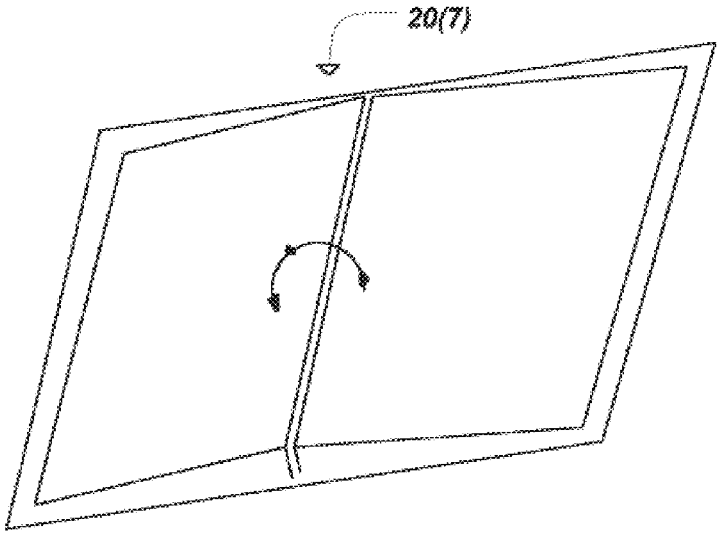
FIG. 7 is a perspective view of a catalog according to the present invention oriented in a split-horizontal configuration.

FIG. 4 shows an example catalog 20(4), which is situated, in a horizontal or lying position on substrate 70. FIG. 4A shows in more detail the binding region of catalog 20(4). FIG. 5, on the other hand, shows an example catalog 20(5) which is situated in an essentially vertical position, attached to a wall or vertical panel 80, for example. It should be understood that orientation positions inclined to the vertical are also possible. FIG. 6 shows an example catalog 20(6) assuming an easel-like orientation. FIG. 7 shows an example catalog 20(7) having a split-horizontal configuration. In other words, the example catalog 20(7) of FIG. 7 is composed by two mirrored half catalogues as prior described in FIG. 4.

Thus, the catalogs of the present invention do not have to rely upon a binder or external structure to impart movement/flexibility of each leaf. Rather, each leaf itself carries and embodies its own mechanism—flex zone 34—for permitting leaf movement.

Figure 8A:
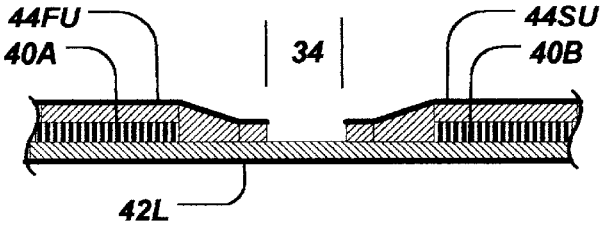
FIG. 8A is a sectioned side view of a first example embodiment of a laminated flexible sheet in an example context of implementation of the present invention.

The inventive flexible laminated leaves or sheets of the invention featuring the flexible zone 34 can be incorporated or implemented in products other than catalogues or bound works. FIG. 8A shows a first example embodiment of a flexible laminated leaf which has a lower laminate film 42L. A display content sheet 40 can be positioned over one or more portions of lower laminate film 42L, with the display content sheet 40 being covered with an upper laminate film 44. For example, FIG. 3A shows an embodiment in which a first segment of upper laminate film 44FU is positioned over a first display content sheet 40A and a second segment of upper laminate film 44SU is positioned over a second display content sheet 40B. No upper laminate film is deposited over flexible zone 34.

Figure 8B:
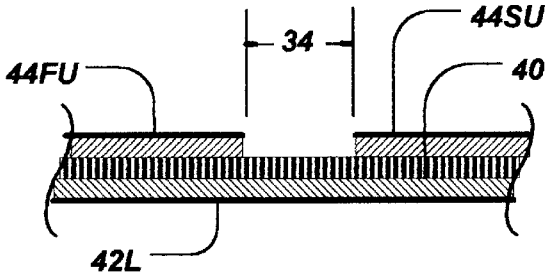
FIG. 8B is a sectioned side view of a second example embodiment of a laminated flexible sheet in another example context of implementation of the present invention.

FIG. 8B shows another embodiment in which the display content sheet 40 extends over the lower laminate film 42L, even in the flexible zone 34. A first segment of the display content sheet 40 is covered by a first segment of upper laminate film 44FU; a second segment of the display content sheet 40 is covered by a second segment of upper laminate film 44SU. Again, no upper laminate film is deposited over flexible zone 34.

Figure 8C:
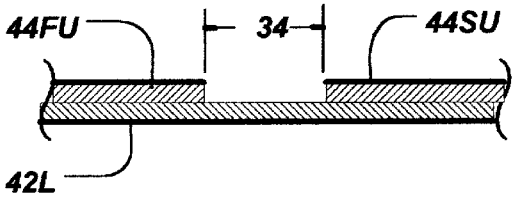
FIG. 8C is a sectioned side view of a third example embodiment of a laminated flexible sheet in another example context of implementation of the present invention.

FIG. 8C shows another embodiment of the invention which resembles that of FIG. 8A, but which need not incorporate a display content sheet under one or both the first segment of upper laminate film 44FU and the second segment of the display content sheet 40. No upper laminate film is deposited over flexible zone 34.

Thus, in the embodiments described above, the flex zone 34 has a smaller thickness than the neighboring content display zones, thereby imparting greater flexibility to each leaf or sheet. In fact, a distinctive characteristic of this flex zone from other general methods of achieving flexibility (die cutting, perforations, etc.) is the relative large flex dimension (1/8"–1/4" wide) when compared with the thickness of the material in this particular flex zone (3/1000"–10/1000"). In this regard, the "width of the flex zone" is illustrated for example as the distance D2–D1 in FIG. 1B, or the distance depicted by numeral 34 in FIG. 8*a*-FIG. 8C. By "thickness of the laminate film" is meant the thickness of the laminate film which exists in the flex zone. The ratio (R) of width of the flex zone to thickness of the laminate film is generally in a range of from 8 to 80. The preferred ratio (R) in order to achieve a large degree of flexibility without undue stress or strain on the laminate film is greater than five (R>5).

Those skilled in the art will recognize that the leaves of the present invention can be fabricated from any of several laminating techniques and conventional lamination machines. For example a Ledco Model HD25 can be used to fabricate the leaves of the present invention. The flex zones can be achieved by suitable choice of sizes for the two laminate films, or by judicious elimination of laminate in flex zone.

Figure 9:
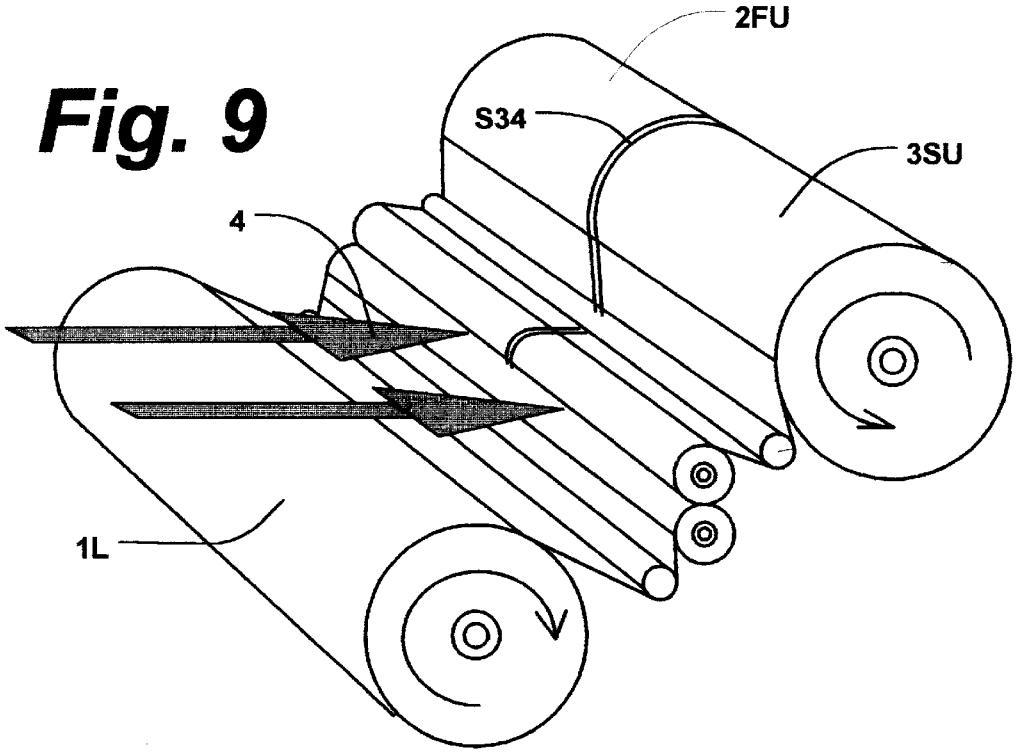
FIG. 9 is a perspective view of an inventive lamination machine suitable for fabricating flexible laminated leaves or sheets according to the present invention.

FIG. 9 shows an inventive roll lamination machine particularly suited for fabricating flexible laminated leaves or sheets according to the present invention. The roll lamination machine of FIG. 9 comprises a single lower laminate feed roller 1L, first upper laminate feed roller 2FU; and second upper laminate feed roller 3SU. The lateral or axial ends of the first upper laminate feed roller 2FU and the second upper laminate feed roller 3SU are separated by a space or gap S34. The space S34 essentially corresponds with the flex zone 34 of the inventive sheets and leaves previously described. For embodiments in which a display content sheet 40 is inserted between laminate films, the arrows 4 indicate the insertion place for the matter to be laminated. The notations FU, SU and L in FIG. 9 are to be construed consistently with FIG. 8A, FIG. 8B, and FIG. 8C.

As evident from the foregoing, the present invention also encompasses as one of its aspects a method or process in which a second laminate film is selectively deposited or placed over a substrate laminate film in a manner to form the flex zone (as described above) in one or more regions in which the second laminate is not placed over the substrate laminate film.

The present invention advantageously has flexibility for each leaf in its flex zone. The one free layer of laminate film comprising the flex zone is bendable, and yet resistant, and allows the decreased thickness of the flex zone relative to the thickness of the display zone. Consequentially, the overall thickness of the products can be made thinner, with better appearance and life span.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. For example, in the context of the catalogues herein described, the binder 24 can extend the entire or part of binding edge 48, and be either continuous or a series of binding (contact) points.

What is claimed is:

1. A catalog comprising:

a plurality of leaves;

a binder for securing the plurality of leaves in fixed relation to one another;

at least one of the leaves having each of the following:

a display zone comprising a display content sheet interposed between two laminate films, at least one of the laminate films being at least semi-transparent, the display zone having a first thickness;

a binding zone wherein the plurality of leaves interface with the binder;

a flex zone intermediate the display zone and the binding zone, the flex zone comprising one laminate film and being of a second thickness which is less than the first thickness.

2. The catalog of claim 1, wherein the flex zone comprises only one laminate film.

3. The catalog of claim 1, wherein the binding zone also comprises one laminate film and is of the second thickness.

4. The catalog of claim 1, wherein the binding zone comprises plural laminate films and has a binding zone thickness greater than the second thickness.

5. The catalog of claim 1, wherein at least one of the laminate films is a heat-activated laminate film.

6. The catalog of claim 1, wherein at least one of the laminate films is a polyethylene film.

7. The catalog of claim 1, wherein the binding zone extends along an edge of the at least one of the leaves, and wherein the flex zone of the at least one of the leaves extends essentially parallel to the binding zone.

8. The catalog of claim 1, wherein the binder comprises an adhesive.

9. The catalog of claim 1, wherein the binder comprises a fastener which extends through the binding zone of the plurality of leaves.

10. The catalog of claim 1, wherein the binder comprises a retaining member and at least one fastener, the fastener extending through the first retaining member and through the binding zone of the plurality of leaves.

11. The catalog of claim 1, wherein the second thickness for the flex zone is less than five mils, and preferably less than three mils.

12. The catalog of claim 1, wherein the ratio of a width of the flex zone to a thickness of the one laminate film comprising the flex zone is greater than five (R>5).

13. A leaf for a catalog, the leaf comprising a display zone comprising a display content sheet interposed between two laminate films, at least one of the laminate films being at least semi-transparent;

a binding zone wherein the plurality of leaves interface with a binder;

a flex zone intermediate the display zone and the binding zone, the flex zone comprising one laminate film and having a smaller thickness than a sum of thicknesses of the two laminate films of the display zone.

14. A leaf for a catalog, the leaf comprising a display zone comprising a display content sheet interposed between two laminate films, at least one of the laminate films being at least semi-transparent, the display zone having a first thickness;

a binding zone wherein the plurality of leaves interface with a binder;

a flex zone intermediate the display zone and the binding zone, the flex zone comprising one laminate film and being of a second thickness which is less than the first thickness, wherein the flex zone comprises only one laminate film.

15. A leaf for a catalog, the leaf comprising a display zone comprising a display content sheet interposed between two laminate films, at least one of the laminate films being at least semi-transparent, the display zone having a first thickness;

a binding zone wherein the plurality of leaves interface with a binder;

a flex zone intermediate the display zone and the binding zone, the flex zone comprising one laminate film and being of a second thickness which is less than the first thickness, wherein the binding zone also comprises one laminate film and is of the second thickness.

16. The leaf of claim 13, wherein the binding zone comprises plural laminate films and has a binding zone thickness greater than the second thickness.

17. The leaf of claim 13, wherein at least one of the laminate films is a heat-activated laminate film.

18. The leaf of claim 13, wherein at least one of the laminate films is a polyethylene film.

19. The leaf of claim 13, wherein the binding zone extends along an edge of the at least one of the leaves, and wherein the flex zone of the at least one of the leaves extends essentially parallel to the binding zone.

20. The leaf of claim 13, wherein the second thickness for the flex zone is less than five mils, and preferably less than three mils.

21. The leaf of claim 13, wherein the a ratio of a width of the flex zone to the second thickness is greater than five (R>5).

22. A leaf of printed matter comprising a first laminate film which functions as a substrate;

a second laminate film;

at least one of the laminate films being at least semi-transparent;

a display zone comprising a display content sheet interposed between at least a portion of the first laminate film and at least a portion of the second laminate film;

the first laminate film having a flex zone which is not covered by the second laminate film for providing flexibility to the leaf.

23. The leaf of claim 22, wherein the flex zone has a thickness which is less than a thickness of the display zone.

24. The leaf of claim 22, wherein at least one of the laminate films is a heat-activated laminate film.

25. The leaf of claim 22, wherein at least one of the laminate films is a polyethylene film.

26. The leaf of claim 22, wherein the thickness of the flex zone is less than five mils, and preferably less than three mils.

27. The leaf of claim 22, wherein the a ratio of a width of the flex zone to a thickness of the first laminate film is greater than five (R>5).

28. The leaf of claim 14, wherein at least one of the laminate films is a heat-activated laminate film.

29. The leaf of claim 14, wherein at least one of the laminate films is a polyethylene film.

30. The leaf of claim 15, wherein at least one of the laminate films is a heat-activated laminate film.

31. The leaf of claim 15, wherein at least one of the laminate films is a polyethylene film.

* * * * *